US011617461B2

(12) United States Patent
Blore

(10) Patent No.: US 11,617,461 B2
(45) Date of Patent: Apr. 4, 2023

(54) FOOD PRODUCT STORAGE AND SERVING ASSEMBLY

(71) Applicant: Daniel Blore, Painesville, OH (US)

(72) Inventor: Daniel Blore, Painesville, OH (US)

( * ) Notice: Subject to any disclaimer, the term of this patent is extended or adjusted under 35 U.S.C. 154(b) by 102 days.

(21) Appl. No.: 16/994,800

(22) Filed: Aug. 17, 2020

(65) Prior Publication Data

US 2021/0045554 A1 Feb. 18, 2021

Related U.S. Application Data

(60) Provisional application No. 62/886,998, filed on Aug. 15, 2019.

(51) Int. Cl.
*A47G 19/26* (2006.01)
*B65D 85/74* (2006.01)

(52) U.S. Cl.
CPC ..... *A47G 19/26* (2013.01); *B65D 85/74* (2013.01)

(58) Field of Classification Search
CPC ..... B65D 47/0885; B65D 85/1063; B65D 83/206; B65D 5/6661; B65D 5/6655; B65D 2251/1091; B65D 43/169; B65D 43/166; B65D 43/164; B65D 5/6697; B65D 2517/5094; B65D 85/74; A47G 19/26
IPC ..... B65D 47/0885
See application file for complete search history.

(56) References Cited

U.S. PATENT DOCUMENTS 1,796,212 A 3/1931 Nadeo
D93,368 S 9/1934 West
D158,999 S 6/1950 Paul
D171,939 S 4/1954 Hubsch
2,840,907 A 7/1958 Herman
4,408,919 A * 10/1983 Wolff ..... A47G 19/303 401/12
4,625,898 A * 12/1986 Hazard ..... B65D 47/0819 222/546
4,892,225 A * 1/1990 von Zelewski ..... A47G 19/26 220/592.15

(Continued)

OTHER PUBLICATIONS

Better Dish Flip-Top Butter Dish without Spreader, first available Oct. 25, 2018, Amazon, [online], [site visited Dec. 17, 2021], Available from internet URL:https://www.amazon.com/Better-Dish-Flip-Top-without-Spreader/dp/B07JQ2PJM1 (Year: 2018).

(Continued)

*Primary Examiner* — Kareen K Thomas
(74) *Attorney, Agent, or Firm* — McDonald Hopkins LLC

(57) ABSTRACT

The disclosure relates to a butter dish that has at least two separate and independent compartments that are each individually capable of storing or serving a full stick of butter or other food product. The butter dish has two compartments and can hold a full stick of butter in each compartment or two sticks of butter in total. The compartments may include a rotatable lid or the compartment may be itself rotatable from the body of the device. An upper compartment comprises a rotatable lid and a bottom compartment is rotatable from the body of the device. The compartments may be located on opposite sides of the device and open from opposite ends. The device may further include one or more additional features such as an angled base to assist in ease of cutting and serving the butter as well as notches along the body for storing a butter knife.

16 Claims, 12 Drawing Sheets

(56) References Cited

U.S. PATENT DOCUMENTS

| | | | | |
|---|---|---|---|---|
| 5,325,969 | A * | 7/1994 | Gordon | A45C 11/20 206/541 |
| D391,809 | S | 3/1998 | Jeppesen | |
| D448,251 | S | 9/2001 | Bodum | |
| 6,283,316 | B1 * | 9/2001 | Sherman | B65D 81/3283 215/6 |
| 6,352,013 | B1 | 3/2002 | Schlattl | |
| 7,258,251 | B2 * | 8/2007 | Johnson | A47G 19/183 222/129 |
| D623,472 | S | 9/2010 | Bodum | |
| 7,968,132 | B2 * | 6/2011 | Archie, Jr. | A45C 11/20 206/541 |
| D659,380 | S | 5/2012 | Mayer | |
| 8,777,044 | B1 * | 7/2014 | Raymus | B65D 81/3205 222/129 |
| D720,961 | S | 1/2015 | Gabriel | |
| 9,038,840 | B2 | 5/2015 | Umholtz | |
| 9,498,036 | B1 * | 11/2016 | Osorio | A45C 13/02 |
| 10,869,578 | B2 * | 12/2020 | Fang | A47J 47/01 |
| 10,926,913 | B2 * | 2/2021 | Allers | B65D 21/0223 |
| D917,238 | S | 4/2021 | Shi | |
| D948,292 | S * | 4/2022 | Deng | D7/605 |
| 2004/0011216 | A1 | 1/2004 | Jodrey | |
| 2004/0163510 | A1 | 8/2004 | Weisfeld | |
| 2007/0227617 | A1 | 10/2007 | Tsai | |
| 2009/0108003 | A1 * | 4/2009 | Tripsianes | B65D 51/18 220/521 |
| 2010/0065561 | A1 * | 3/2010 | Valley, III | B65D 43/16 220/837 |
| 2015/0375918 | A1 * | 12/2015 | Holderness | B67D 3/0067 220/592.2 |
| 2016/0114942 | A1 * | 4/2016 | Mussio | B65D 25/2897 220/500 |
| 2016/0255974 | A1 * | 9/2016 | Mertzel | A47G 19/26 |
| 2018/0116434 | A1 * | 5/2018 | Mertzel | A47G 19/26 |
| 2019/0291944 | A1 * | 9/2019 | Scully | B65D 85/74 |

OTHER PUBLICATIONS

Better Butter Dish, first available Jun. 27, 2021, Amazon, [online], [site visited Dec. 17, 2021], Available from internet URL: hyperlink (Year: 2021).

* cited by examiner

FOOD PRODUCT STORAGE AND SERVING ASSEMBLY

CROSS REFERENCE TO RELATED APPLICATION

This utility application claims priority to and the benefit of application of U.S. Provisional Patent Application No. 62/886,998, filed on Aug. 15, 2019, the entirety of the application is hereby incorporated by reference.

FIELD OF THE DISCLOSURE

The disclosure relates to a food product storage and serving assembly and more particular for an assembly for storing and serving sticks of butter.

BACKGROUND OF THE DISCLOSURE

Food product storage and serving assemblies as well as butter dishes are well known containers for storing and serving food. Typically, known containers include a plate for supporting the food product and a removable cover to provide access. Several problems exist with such assemblies including the lack of spacing between the cover and the food product and the handling of the cover when removed or during access to the food product. Another problem encountered with butter dishes relates to the butter spreader.

Typically, a butter dish may be configured to support a spreader such as a knife or utensil. An outer support may be provided on a dish or a cover for holding or supporting the spreader when not in use. For example, U.S. Publication No. 2004/0011216 illustrates a depression formed in the top of a cover for storing a spreader. U.S. Pat. No. 2,840,907 illustrates, in one embodiment, openings in the top of an interior tray for storing a spreader. U.S. Patent Publication No. 2018/0116434 discloses a butter dish securable spreader in a rotatable lid with a large opening for the butter. These known assemblies may be costly, oversized, or otherwise unable to efficiently store and serve butter in a way that would be desirable to most users.

This disclosure addresses these and other deficiencies of the prior art and in particular looks to provide an improved food product storage and serving assembly that is compact, efficient and allows for ease of use with multiple storage compartments. The features and advantages of the present disclosure may further be apparent from the following summary and description of the preferred embodiments considered together with the accompanying drawings.

SUMMARY OF THE DISCLOSURE

The disclosure relates to a food product dish that has at least two separate and independent compartments that are each individually capable of storing or serving a full stick of butter or other food product. The food product dish has two compartments and can hold a full stick of butter in each compartment or two sticks of butter in total. The compartments may include a rotatable lid or the compartment may be itself rotatable from the body of the device. An upper compartment comprises a rotatable lid and a bottom compartment is rotatable from the body of the device. The compartments may be located on opposite sides of the device and open from opposite ends. The device may further include one or more additional features such as an angled base to assist in ease of cutting and serving the food product as well as notches along the body for storing a utensil such as a butter knife.

In an embodiment, provided is a food product storage and service assembly comprising a base that defines a first cavity spaced from a second cavity wherein the first cavity is configured to receive a first food product item and second cavity is configured to receive a second food product item. A cover member rotatably attached to said base and configured to be pivoted between an open position and a closed position relative to the base to provide access to the first cavity. A support member that defines a container portion that is configured to support a food product item, wherein the support member is rotatably attached to the base and configured to be pivoted between an open position and a closed position relative to the base to provide access to the second cavity.

In the embodiments contemplated by this disclosure, the first food product item may be a stick of butter and the second food product item may be a stick of butter. The cover member may be shaped as a generally arcuate member having a first edge and an opposite rear edge wherein the first edge is generally parallel to and spaced from the rear edge. The cover member may be rotatably attached to the base by a first tab and a second tab wherein each tab extends from the cover member and each tab is spaced from one another along a common axis and extends from the cover member. The first tab may include a first protrusion that faces inwardly towards the second tab and the second tab may include a second protrusion that faces inwardly towards the first tab wherein the first and second protrusions are configured to be received in apertures positioned along the base wherein the first and second protrusions are shaped to provide a snap fit between the cover member and the base and allow the cover member to rotate between the open position and the closed position relative to the base. The container portion of the support member may include a plurality of sides shaped to retain a food product including a front side, a rear side, and a bottom side such that the container portion is generally opened to allow the food product to be exposed within the support member and the support member is configured to be placed within the second cavity of the base when the support member is in the closed position.

The support member may further comprise a first tab and a second tab wherein the first tab includes a first protrusion that faces outwardly away from the second tab and the second tab includes a second protrusion that faces outwardly away from the first tab wherein the first and second protrusions are configured to be received in apertures positioned along the base wherein the first and second protrusions are shaped to provide a snap fit between the support member and the base and allow the support member to rotate between the open position and the closed position relative to the base. The apertures may be positioned along the base, be aligned along a common axis, and be positioned along a first side wall and an opposite second side wall of the base and positioned at a location aligned with and below an apex of a cavity surface within the base. At least one of the first tab and the second tab of the cover member may be defined by a perimeter edge and the base includes at least one ramped portion along a side wall of the base adjacent to an aperture along a hinge portion. The perimeter edge may include a forward edge and a rearward edge opposite the forward edge wherein the at least one first tab and second tab extends in a generally angled direction from the rear edge in a direction away from the front edge. At least one ramped portion may be positioned adjacent to an aperture such that said aperture is generally recessed from the side wall to allow the ramped portion to extend outwardly from the side wall and allow the perimeter edge of the at least one first tab and second tab to be pivotally engagable with the ramp portion. The ramp portion may be configured to abut said forward edge when the cover member is in the closed position and is configured to abut said rearward edge when the cover member is in the open position.

In additional embodiment, the base may include a first side wall spaced from a second side wall, a cavity surface positioned between the first side wall and the second side wall to define the first cavity wherein the cavity surface is configured to support a food product in the first cavity. The cavity surface may be defined by a first angled surface and a second angled surface such that the food product may be positioned at an angle relative to a bottom surface of the base. The base may include a hinge portion spaced from the first cavity and the second cavity and is configured to be rotatably attach to the cover member. The hinge portion may include a first aperture along the first side wall and a second aperture along the second side wall wherein the first aperture and second aperture are aligned along a common access and configured to receive a first protrusion and a second protrusion of the cover member to allow the cover member to be rotatably attached to the base. The base may include a first notch located in the first side wall and a second notch located in the second side wall wherein the first notch and second notch are configured to allow for the support of an elongated utensil. The first notch and second notch may be located along a perimeter of the first and second side walls wherein the cover member is configured to be pivoted between the opened position and the closed position while the elongated utensil is positioned against the first and second notch as the food product may be located within the first cavity.

DETAILED DESCRIPTION OF THE DISCLOSURE

Figure 1:
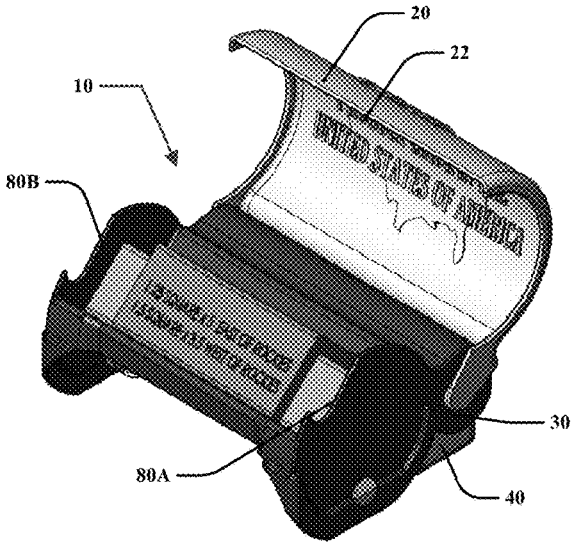
FIG. 1 is a front perspective view of an embodiment of a food product storage and serving assembly in a top open position of the present disclosure.

Reference will now be made in detail to exemplary embodiments of the present invention, examples of which are illustrated in the accompanying drawings. It is to be understood that other embodiments may be utilized and structural and functional changes may be made without departing from the respective scope of the invention. As such, the following description is presented by way of illustration only and should not limit in any way the various alternatives and modifications that may be made to the illustrated embodiments and still be within the spirit and scope of the invention.

As used herein, the words "example" and "exemplary" mean an instance, or illustration. The words "example" or "exemplary" do not indicate a key or preferred aspect or embodiment. The word "or" is intended to be inclusive rather an exclusive, unless context suggests otherwise. As an example, the phrase "A employs B or C," includes any inclusive permutation (e.g., A employs B; A employs C; or A employs both B and C). As another matter, the articles "a" and "an" are generally intended to mean "one or more" unless context suggest otherwise.

FIGS. 1-12 illustrate embodiments of a food product storage and serving assembly 10. The assembly 10 is particularly useful for storing and service sticks of butter. The assembly 10 comprises a cover member 20 rotatably attached to a base 30 and a bottom support member 40 rotatably attached to the base. The cover member 20 and base 30 may define a first or top cavity 50 (FIG. 7B) configured to support a food product therein. The bottom support member 40 and base 30 may define a container portion 42 and a second or bottom cavity 60 (FIG. 7B) configured to support a second food product therein. Notably, in an embodiment, the first and second food products are contemplated to be sticks of butter.

Figure 2:
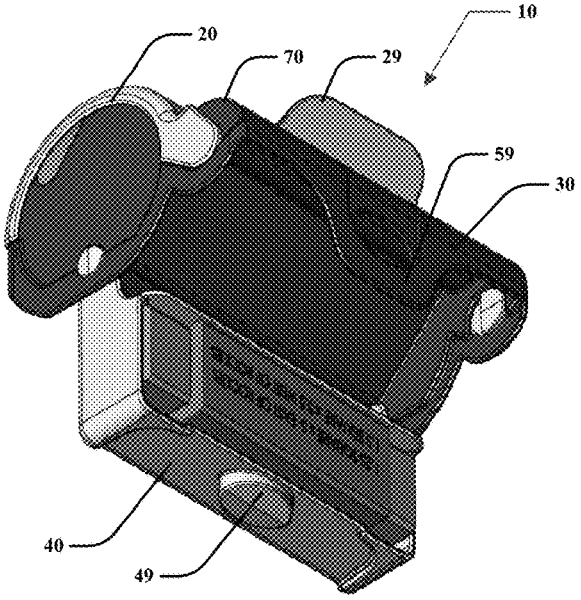
FIG. 2 is a rear perspective view of the food product storage and serving assembly of FIG. 1 in a bottom open position.

FIG. 1 illustrates the cover member 20 pivoted to an open position relative to the base 30 and exposing the first or top cavity 50. FIG. 2 illustrates the bottom support member 40 pivoted to an open position relative to the base 30 along an opposite side of the base 30 than the cover member 20 and exposing the second or bottom cavity 60.

Figure 3:
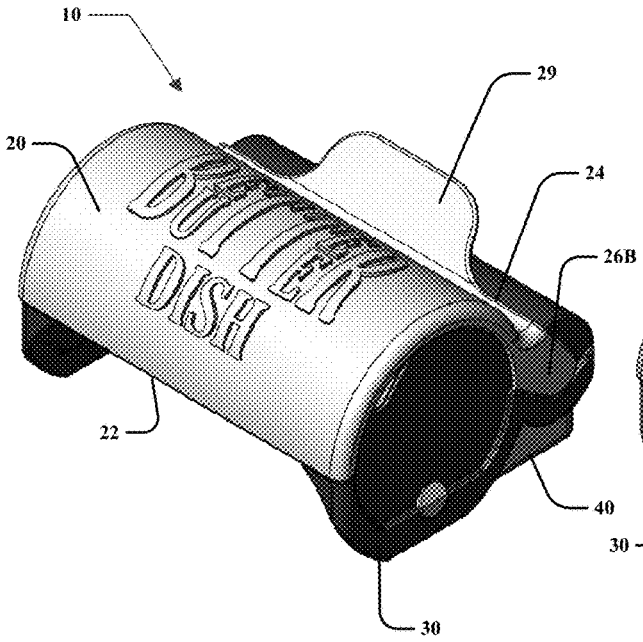
FIG. 3 is a front perspective view of the food product storage and serving assembly of the present disclosure in a closed position.
Figure 4:
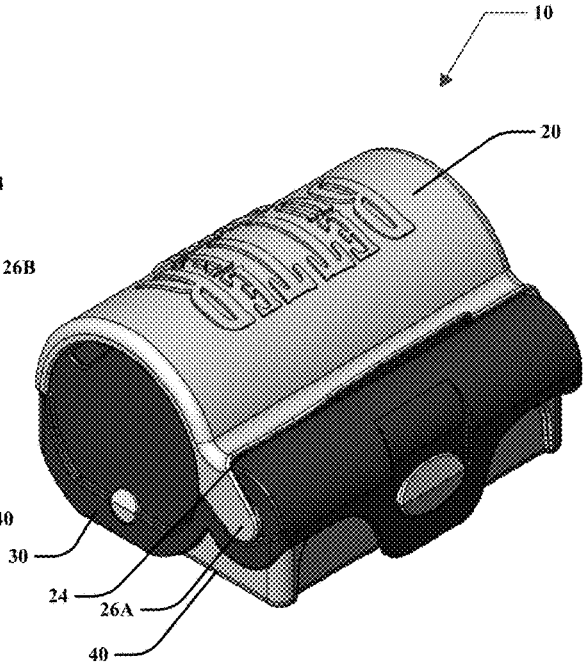
FIG. 4 is a rear perspective view of the food product storage and serving assembly of FIG. 3 in the closed position.
Figure 5:
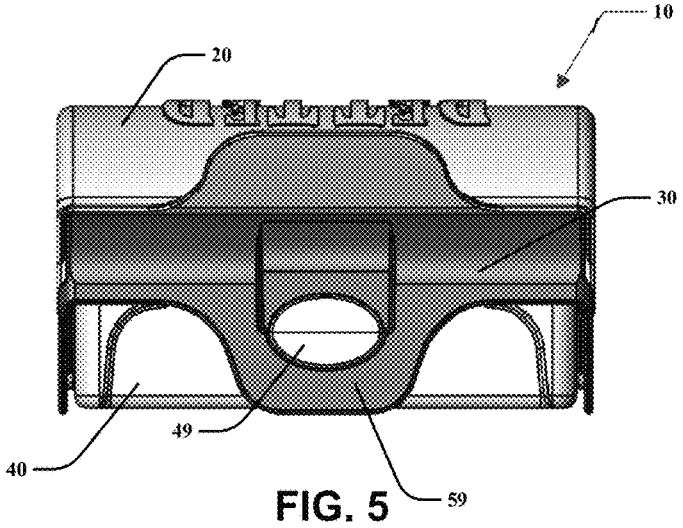
FIG. 5 is a rear view of the food product storage and serving assembly of FIG. 3.
Figure 6:
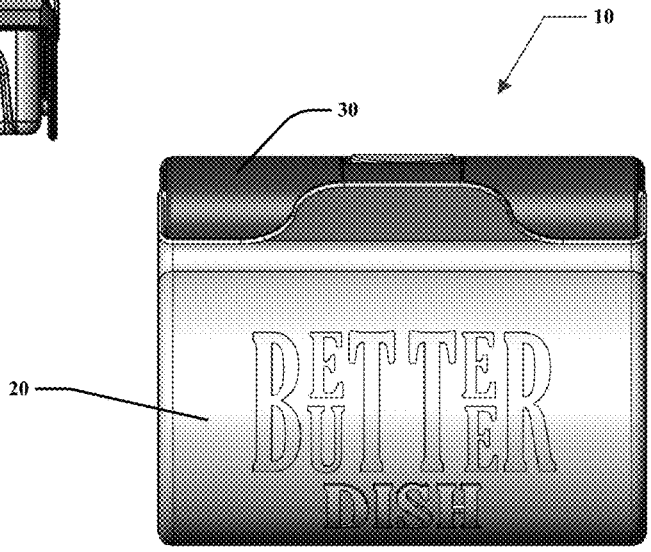
FIG. 6 is a top view of the food product storage and serving assembly of FIG. 3.

FIG. 3 illustrates the cover member 20 pivoted to a closed position relative to the base 30 and restricting access to the first or top cavity 50. FIG. 4 illustrates the bottom support member 40 pivoted to a closed position relative to the base 30 along the opposite side of the base 30 than the cover member 20 and restricting access to the second or bottom cavity 60.

The cover member 20, base 30, and bottom support member 40 may each be made of the same material such as a polymer, plastic, wood, metal, rubber, or other known material sufficient to support a food product therein. Each element may be made of a generally continuous material or may be assembled from separate elements attached to define each feature.

As illustrated by FIGS. 1-6, the cover 20 may be shaped as a generally arcuate member having a first edge 22 and an opposite rear edge 24. The first edge 22 may be generally parallel to and spaced from the rear edge 24. In one embodiment, the cover 20 may be rotatably attached to the base 30 by a pair of tabs 26A, 26B. The tabs 26A, 26B may extend from the cover 20 and be configured to rotatably attach to the base 30. The tabs 26A, 26B may be spaced from one another along or adjacent to the rear edge 24. Further, the tabs 26A, 26B may be configured to be rotatably attached to the base 30 in various ways. In one embodiment, the tabs each include a protrusion 28A, 28B (FIG. 10A) configured to be received by apertures 38A, 38B (FIG. 10B) in the base 30. The tabs 26A, 26B may be positioned so that the protrusions 28A, 28B face inwardly towards one another. The protrusions 28A, 28B and apertures 38A, 38B may be shaped to provide a snap fit between the cover 20 and the base 30 and allow the cover 20 to rotate between the open position and the closed position relative to the base 30 to provide access or restrict access to the top cavity 50.

The cover member 20 may also include a top surface configured to include a logo or indicia thereon and an opposite inner surface (FIG. 1) configured to include a logo or indicia thereon.

A pivot member 29 may extend from the rear edge 24 and be configured to allow a user to grasp or depress the pivot member 29 to cause the cover 20 to rotate relative to the base 30. The pivot member 29 may extend from the rear edge 24 of the cover 20 in a direction that is opposite from the tabs 28A, 28B. The pivot member 29 may have a generally trapezoidal shape (FIG. 3), may have a stepped shape (FIG. 11), or arcuate shape (FIG. 12) or may have various other shapes, sizes, and configurations which are each contemplated by this disclosure.

The base 30 may include a cavity surface 32 configured to support a food product in the top cavity 50. As illustrated by FIG. 7B, the cavity surface 32 may be defined by a first angled surface 33A and a second angled surface 33B to allow a rectangular shaped food product (such as a stick of butter) to be supported thereon such that the food product may be positioned at an angle relative to a bottom surface 34 of the base 30.

Figure 10A:
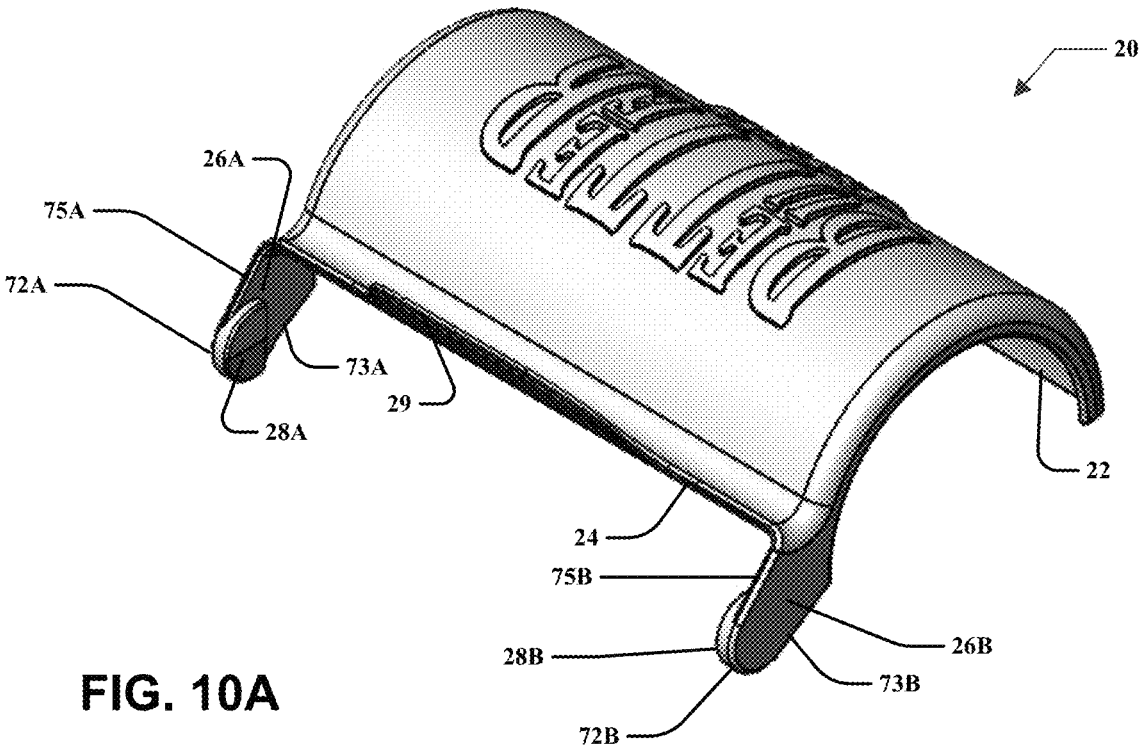
FIG. 10A is a top perspective view of a cover member according to an embodiment of the present disclosure.
Figure 10B:
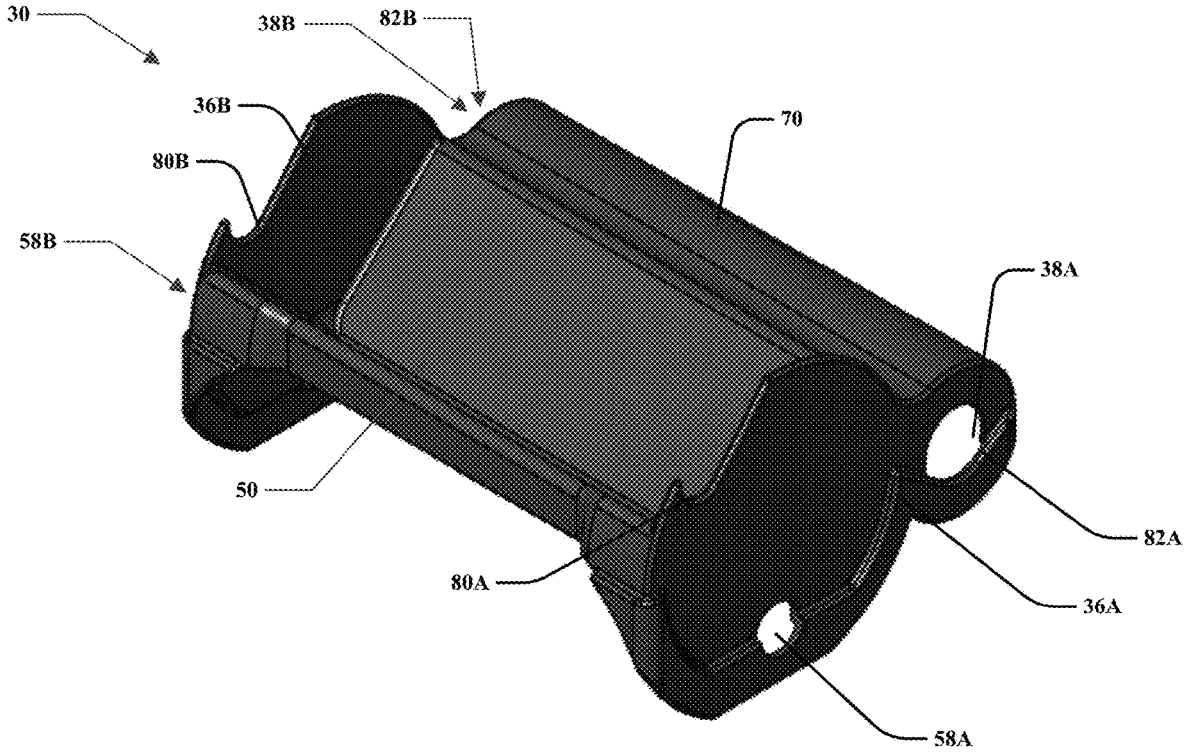
FIG. 10B is a top perspective view of a base according to an embodiment of the present disclosure.
Figure 10C:
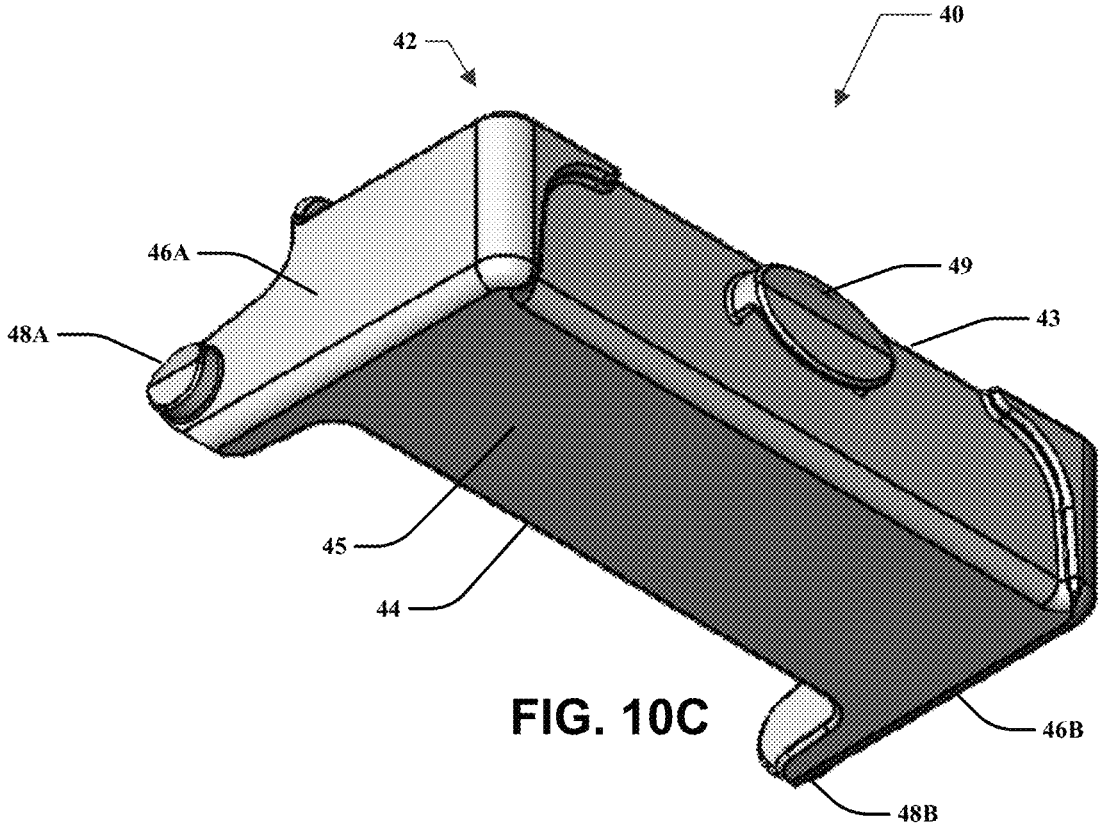
FIG. 10C is a bottom perspective view of a bottom support member according to an embodiment of the present disclosure.
Figure 11:
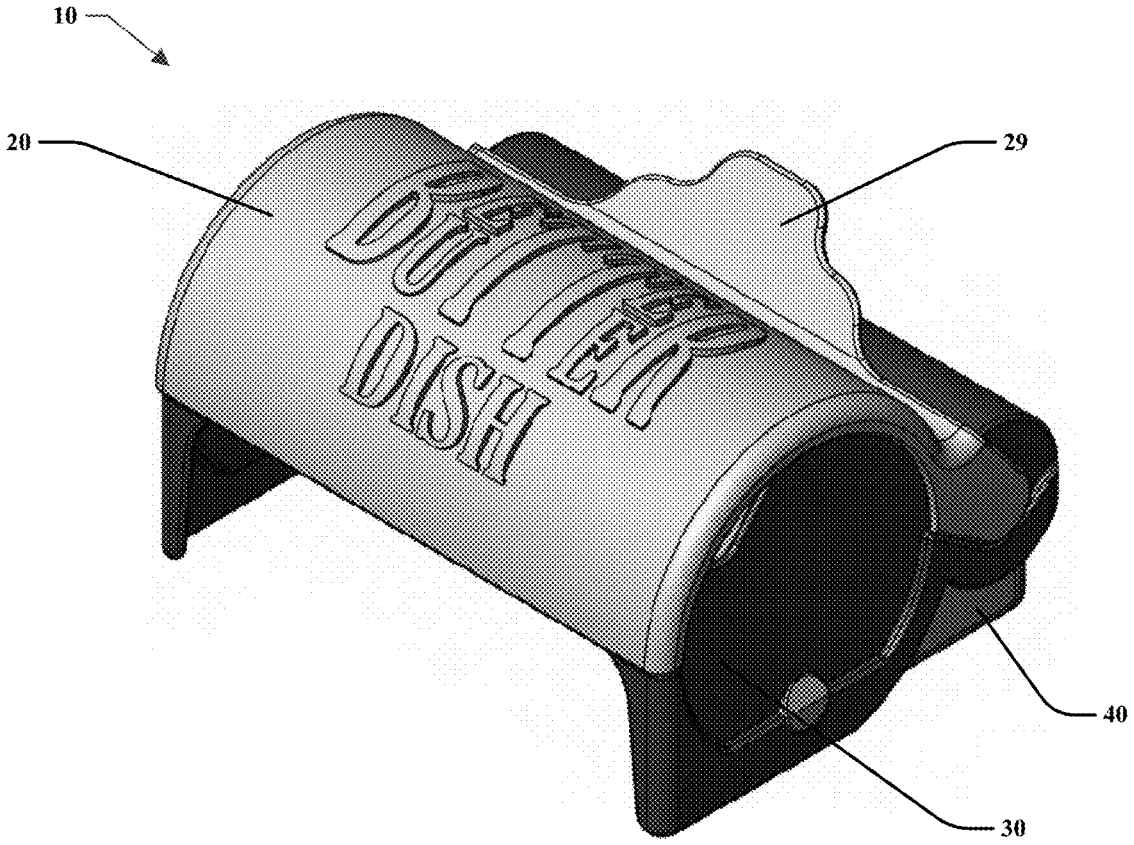
FIG. 11 is a front perspective view of another embodiment of the food product storage and serving assembly of the present disclosure.
Figure 12:
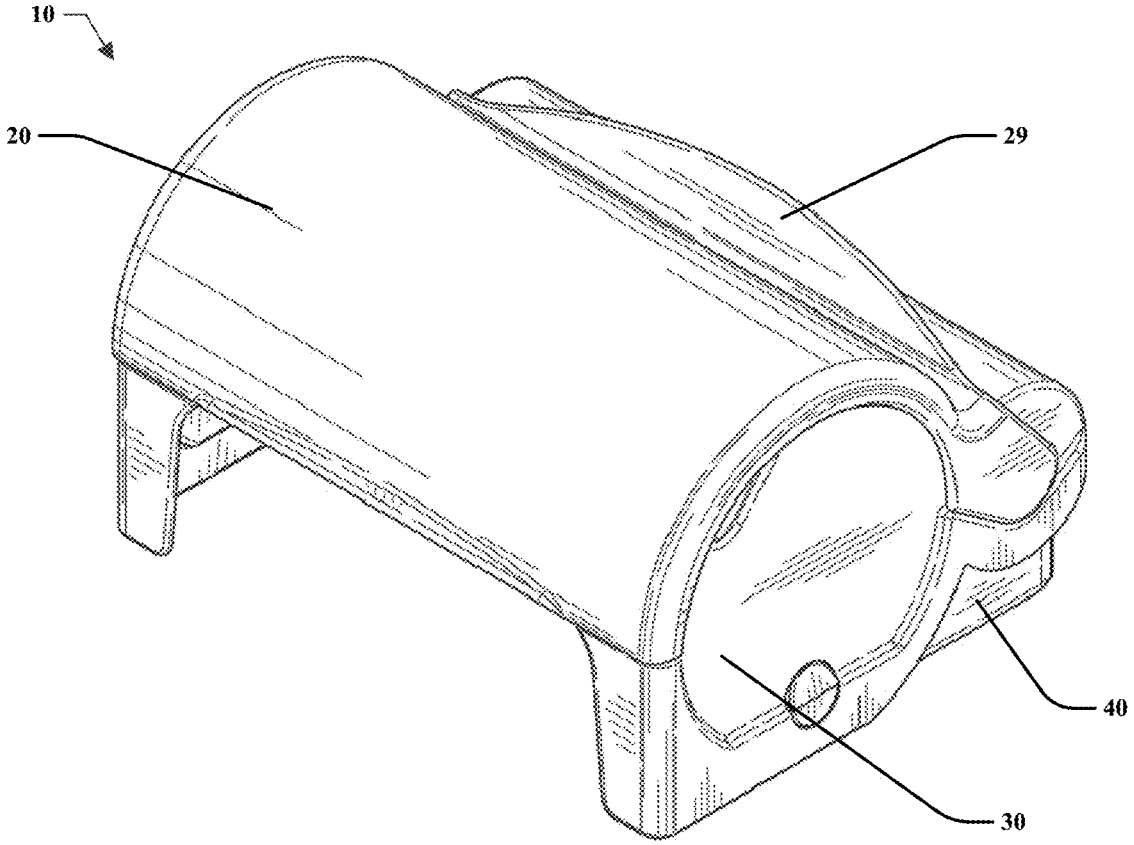
FIG. 12 is a front perspective view of another embodiment of the food product storage and serving assembly of the present disclosure.

As illustrated by FIG. 10B, the base 30 may include a pair of side walls 36A, 36B spaced apart from one another wherein the cavity surface 32 is positioned between the pair of side walls 36A, 36B. The base 30 may include a hinge portion 70 spaced from the top cavity 50 and bottom cavity 60 and be configured to be rotatably attach to the cover member 20. The apertures 38A, 38B may be located along the hinge portion 70 and may be oppositely positioned along the side walls 36A, 36B and aligned along a common axis, respectively.

Further, the second or bottom cavity 60 may be at least partially formed along the opposite side of the base 30. More particularly, the bottom cavity 60 may be along the opposite side of the second angled surface 33B (FIGS. 7B and 9B) and may be positioned between the side walls 36A, 36B.

Figure 7A:
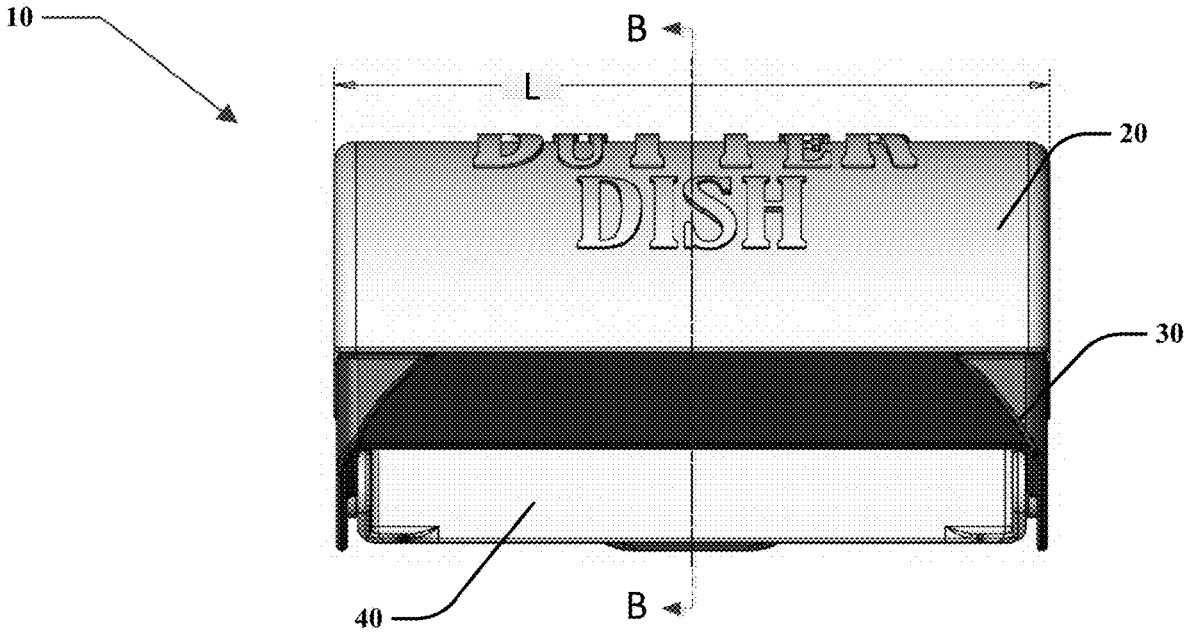
FIG. 7A is a front view of the food product storage and serving assembly of FIG. 3.
Figure 8:
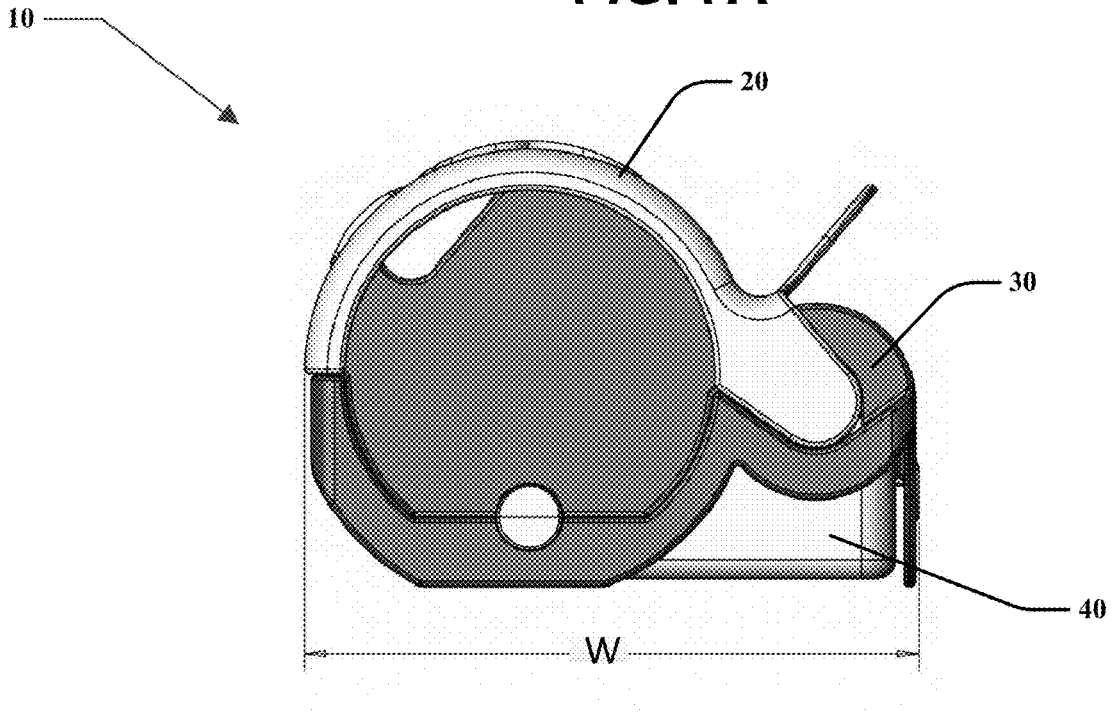
FIG. 8 is a first side view of the food product storage and serving assembly of FIG. 3.
Figure 7B:
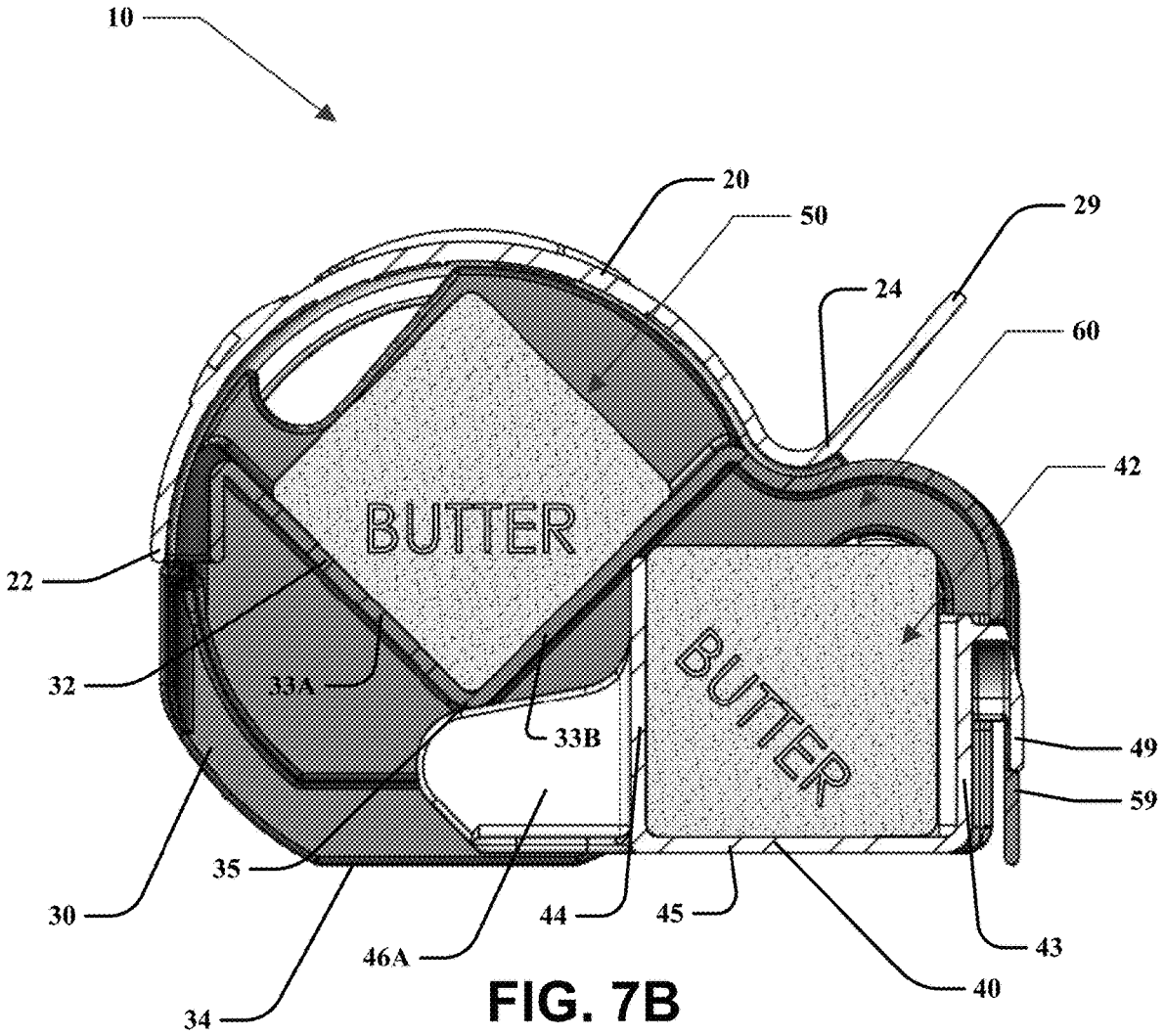
FIG. 7B is a cross sectional side view of the food product storage and serving assembly through line B-B of FIG. 7A.
Figure 9A:
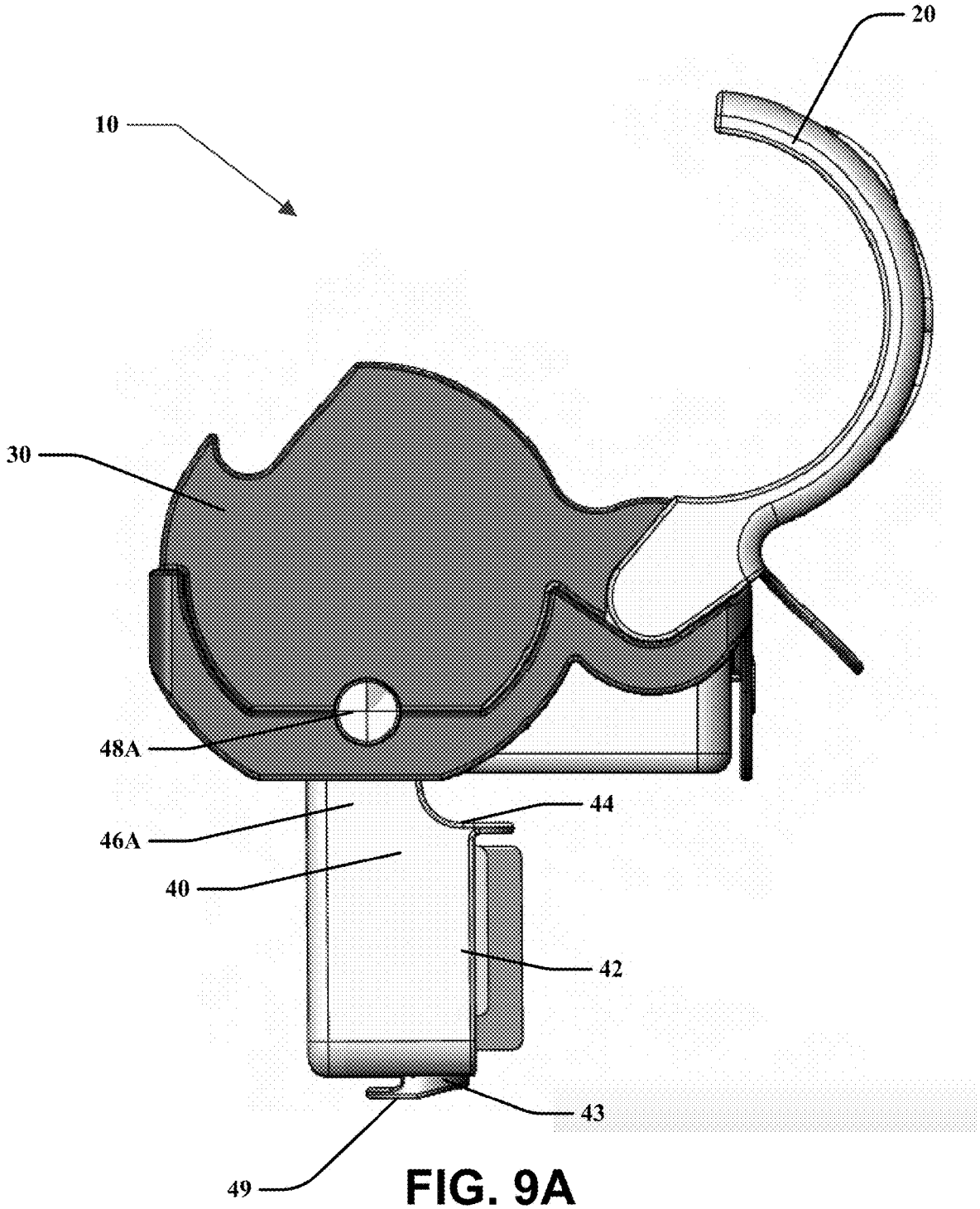
FIG. 9A is a first side view of the food product storage and serving assembly in the top open position and a bottom open position of the present disclosure.
Figure 9B:
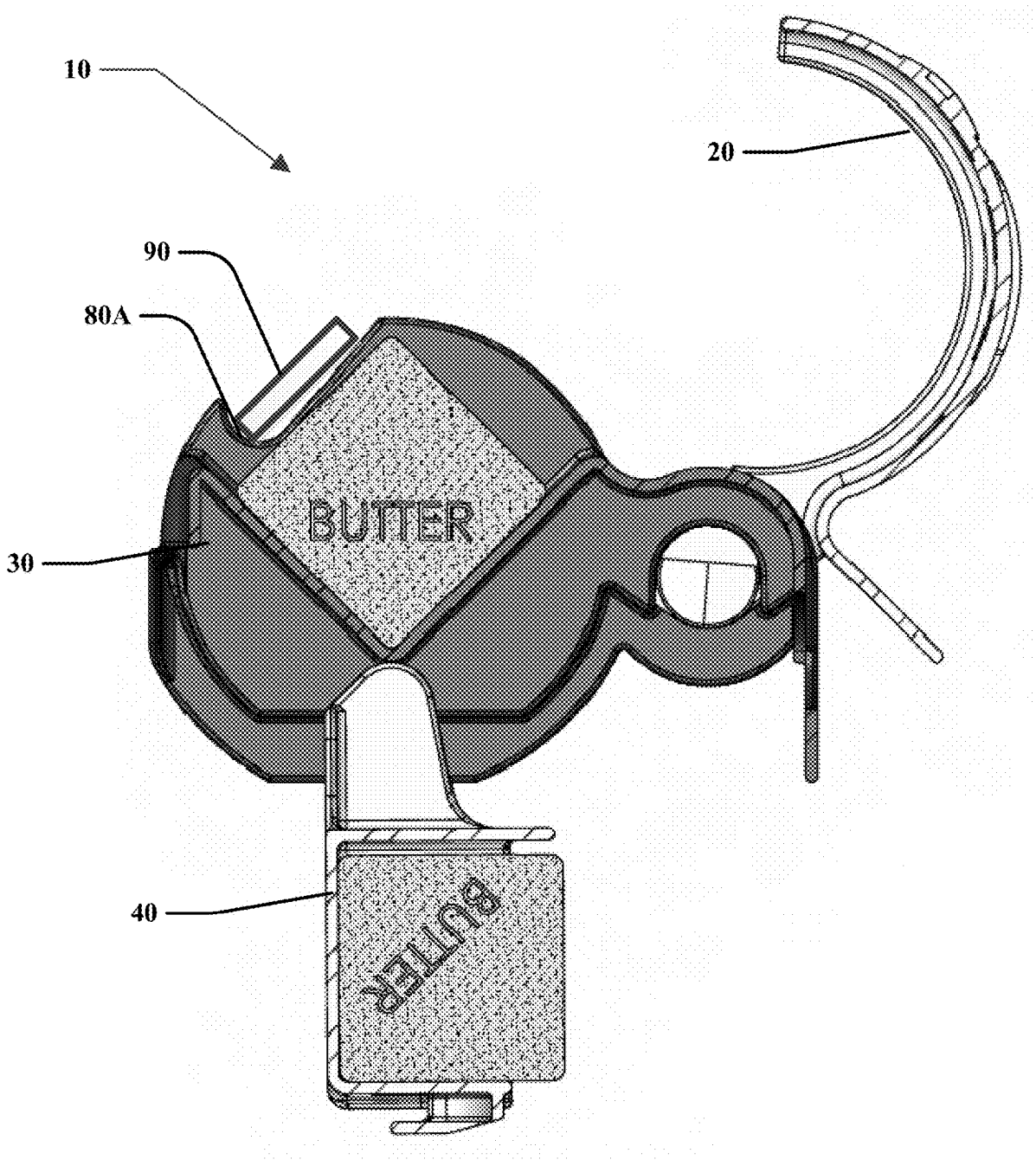
FIG. 9B is a cross sectional side view of the food product storage and serving assembly in the top open position and a bottom open position of the present disclosure.

The bottom support member 40 may be shaped to be rotatably attached to the base 30 such that it may be pivoted between an opened position (FIGS. 9A and 9B) and a closed position (FIGS. 7A and 7B). The support member 40 may include a container portion 42 that includes a plurality of sides shaped to retain a food product such as a stick of butter. The container portion 40 may include a front side 43, a rear side 44 and a bottom side 45 and is generally opened along the top portion to expose the food product within the support member 40.

A pair of tabs 46A, 46B may extend from the rear edge 44 of the support member 40 and be configured to rotatably attach to the base 30. The tabs 46A, 46B may be spaced from one another along the rear side 44 and may each include a protrusion 48A, 48B (FIG. 10C) configured to be received by apertures 58A, 58B (FIG. 10B) in the base 30. The tabs 46A, 46B may be positioned so that the protrusions 48A, 48B face outwardly away from one another. In an embodiment, the apertures 58A, 58B may be aligned along a common axis and be positioned along the side walls 36A, 36B. The apertures 58A, 58B may be positioned at a location aligned with and below an apex 35 of the cavity surface 32. The apex 35 being the portion of the cavity surface 32 between the first angled surface 33A and the second angled surface 33B.

The protrusions 48A, 48B and apertures 58A, 58B may be shaped to provide a snap fit between the support member 40 and the base 30 and allow the support member 40 to rotate between the open position and the closed position relative to the base 30 to provide access to the bottom cavity 60 or access to container portion 42. In the closed position, the bottom side 45 of the support member 40 the bottom surface 34 of the base 30 may be generally aligned to allow the assembly 10 to be placed on a flat surface when not in use.

A button 49 may be positioned along the front edge 43 of the bottom support member 40 and be configured to lock the bottom support member 40 in the closed position relative to the base 30. The base 30 may include a locking member 59 that cooperates with the button 49 such that it may receive the button 49 therein to lock the support member 40 in the closed position. A user may depress the button 49 to unlock the locking member 59 and rotate the support member 40 relative to the base 30. The button 49 may be made of the same material as the support member 40 and be generally continuous therefrom. Similarly, the locking member 59 may be made of the same material as the base 30 and be generally continuous therefrom.

To further describe the pivotal opening and closing function of the cover member 20 relative to the base 30, the tabs 28A, 28B of the cover member 20 may each be defined by a perimeter edge 72A, 72B (See FIG. 10A) and the base 30 may include ramped portions 82A, 82B (See FIG. 10B) along either sides of the base 30 adjacent to the apertures 38A, 38B. The perimeter edges 72A, 72B may include a forward edge 73A, 73B and a rearward edge 75A, 75B opposite the forward edge 73A, 73B such that the tabs 28A, 28B extends in a generally angled direction from the rear edge 24 in a direction away from the front edge 22.

The ramped portions 82A, 82B as illustrated by FIG. 10B may be positioned along either side of the hinge portion 70 along the side walls 36A, 36B. The apertures 38A, 38B may be generally recessed from the side walls 36A, 36B to allow the ramped portions 82A, 82B to extend outwardly from the sidewalls 36A, 36B to allow the perimeter edges 72A, 72B of the tabs 28A, 28B to be pivotally engagable with the ramp portions 82A, 82B. The ramp portions 82A, 82B may function as a rotatable stop for the cover member 20. In an embodiment, the ramp portions 82A, 82B may be shaped to allow the forward edges 73A, 73B to abut against the ramp portion 82A, 82B when the cover member 20 is in the closed position and to allow the rearward edges 75A, 75B to abut against the ramp portions 82A, 82B when the cover member 20 is in the open position.

A pair of notches 80A, 80B may be located in the sidewalls 38A, 38B and allow for the storage or support of an elongated utensil 90 such as a knife or butter spreader. The notches 80A, 80B may be located along the perimeter of the sidewalls 38A, 38B wherein the cover 20 may be rotated between the opened and closed position while the elongated utensil rests against the pair of notches 80A, 80B as the food product may be located within the top cavity 50.

A user can store the assembly 10 in a refrigerator or may serve food product while maintained in the assembly 10. Notably, the assembly 10 is configured in such a way that if a food product melts or liquefies than any runoff would be contained within the cavities as described.

Notably, butter sticks commercially available in the United States east of the Rocky Mountains are generally about 1.25" wide by 5" long while sticks of butter west of the Rocky mountains are generally about 1.5" wide by 3.5" long. The assembly 10 is contemplated to store and serve sticks of butter from both east and west of the Rocky Mountains and can snuggly receive and support sticks of butter that are either 1.25" wide by 5" long or 1.5" wide by 3.5" long.

Having described preferred embodiments of a new food product storage and serving assembly, it is believed that other modifications, variations and changes will be suggested to those skilled in the art in view of the teachings set forth herein. It is therefore to be understood that all such variations, modifications and changes are believed to fall within the scope of the present disclosure.

Although the disclosure has been described with reference to certain embodiments detailed herein, other embodiments can achieve the same or similar results. Variations and modifications of the disclosure will be obvious to those skilled in the art and the disclosure is intended to cover all such modifications and equivalents.

What is claimed is:

1. A food product storage and service assembly comprising:

a base that defines a first cavity spaced from a second cavity wherein the first cavity is configured to receive a first food product item and second cavity is configured to receive a second food product item;

a cover member rotatably attached to said base and configured to be pivoted between an open position and a closed position relative to the base to provide access to the first cavity; and a support member that defines a container portion that is configured to support a food product item, wherein the support member is rotatably attached to the base and configured to be pivoted between an open position and a closed position relative to the base to provide access to the second cavity;

wherein the cover member is rotatably attached to the base by a first tab and a second tab wherein each tab extends from the cover member and each tab is spaced from one another along a common axis and extends from the cover member;

wherein the first tab includes a first protrusion that faces inwardly towards the second tab and the second tab includes a second protrusion that faces inwardly towards the first tab wherein the first and second protrusions are configured to be received in apertures positioned along the base wherein the first and second protrusions are shaped to provide a snap fit between the cover member and the base and allow the cover member to rotate between the open position and the closed position relative to the base.

2. The food product storage and service assembly of claim 1, wherein the first food product item is a stick of butter and the second food product item is a stick of butter.

3. The food product storage and service assembly of claim 1, wherein the cover member is shaped as a generally arcuate member having a first edge and an opposite rear edge wherein the first edge is generally parallel to and spaced from the rear edge.

4. The food product storage and service assembly of claim 1, wherein the container portion of the support member includes a plurality of sides shaped to retain a food product including a front side, a rear side, and a bottom side such that the container portion is generally opened along a top to allow the food product to be exposed within the support member and the support member is configured to be placed within the second cavity of the base when the support member is in the closed position.

5. A food product storage and service assembly comprising:

a base that defines a first cavity spaced from a second cavity wherein the first cavity is configured to receive a first food product item and the second cavity is configured to receive a second food product item;

a cover member rotatably attached to said base and configured to be pivoted between an open position and a closed position relative to the base to provide access to the first cavity; and a support member that defines a container portion that is configured to support a food product item, wherein the support member is rotatably attached to the base and configured to be pivoted between an open position and a closed position relative to the base to provide access to the second cavity;

wherein the support member further comprises a first tab and a second tab wherein the first tab includes a first protrusion that faces outwardly away from the second tab and the second tab includes a second protrusion that faces outwardly away from the first tab wherein the first and second protrusions are configured to be received in apertures positioned along the base wherein the first and second protrusions are shaped to provide a snap fit between the support member and the base and allow the support member to rotate between the open position and the closed position relative to the base.

6. The food product storage and service assembly of claim 5, wherein the apertures positioned along the base are aligned along a common axis and are positioned along a first side wall and an opposite second side wall of the base and positioned at a location aligned with and below an apex of a cavity surface within the base.

7. The food product storage and service assembly of claim 5 wherein at least one of the first tab and the second tab of the cover member is defined by a perimeter edge and the base includes at least one ramped portion along a side wall of the base adjacent to an aperture along a hinge portion.

8. The food product storage and service assembly of claim 7, wherein the perimeter edge includes a forward edge and a rearward edge opposite the forward edge and the at least one first tab and second tab extends in a generally angled direction from the rear edge in a direction away from the front edge.

9. The food product storage and service assembly of claim 8, wherein the at least one ramped portion is positioned adjacent to an aperture such that said aperture is generally recessed from the side wall to allow the ramped portion to extend outwardly from the sidewalls and allow the perimeter edge of the at least one first tab and second tab to be pivotally engagable with the ramp portion.

10. The food product storage and service assembly of claim 9, wherein the ramp portion is configured to abut said forward edge when the cover member is in the closed position and is configured to abut said rearward edge when the cover member is in the open position.

11. A food product storage and service assembly comprising:

a base that defines a first cavity spaced from a second cavity wherein the first cavity is configured to receive a first food product item and second cavity is configured to receive a second food product item;

a cover member rotatably attached to said base and configured to be pivoted between an open position and a closed position relative to the base to provide access to the first cavity; and a support member that defines a container portion that is configured to support a food product item, wherein the support member is rotatably attached to the base and configured to be pivoted between an open position and a closed position relative to the base to provide access to the second cavity;

wherein the base includes a first side wall spaced from a second side wall, a cavity surface positioned between the first side wall and the second side wall to define the first cavity wherein the cavity surface is configured to support a food product in the first cavity;

wherein the cavity surface is defined by a first angled surface and a second angled surface such that the food product may be positioned at an angle relative to a bottom surface of the base.

12. The food product storage and service assembly of claim 11, wherein the base includes a hinge portion spaced from the first cavity and the second cavity and is configured to be rotatably attach to the cover member.

13. The food product storage and service assembly of claim 12, wherein the hinge portion includes a first aperture along the first side wall and a second aperture along the second side wall wherein the first aperture and second aperture are aligned along a common access and configured to receive a first protrusion and a second protrusion of the cover member to allow the cover member to be rotatably attached to the base.

14. The food product storage and service assembly of claim 11, wherein the base includes a first notch located in the first side wall and a second notch located in the second side wall wherein the first notch and second notch are configured to allow for the support of an elongated utensil.

15. The food product storage and service assembly of claim 14, wherein the first notch and second notch are located along a perimeter of the first and second side walls wherein the cover member is configured to be pivoted between the opened position and the closed position while the elongated utensil is positioned against the first and second notch as the food product may be located within the first cavity.

16. The food product storage and service assembly of claim 11, wherein when the support member is in the closed position, a bottom side of the support member and a bottom surface of the base may be generally aligned to allow the assembly to be placed on a flat surface.

* * * * *